United States Patent [19]

Goedecke et al.

[11] Patent Number: 5,016,519

[45] Date of Patent: May 21, 1991

[54] LINEAR DRIVE

[76] Inventors: Wolf-Dieter Goedecke, Bachweg 12, D-7731 Unterkirnach; Reinhard Schwenzer, Rosstrasse 78, D-4000 Düsseldorf; Ralf Huber, Hauptstrasse 33, D-7734 Brigachtal, all of Fed. Rep. of Germany

[21] Appl. No.: 113,644

[22] Filed: Dec. 18, 1987

Related U.S. Application Data

[63] Continuation-in-part of Ser. No. 784,477, Oct. 4, 1985, abandoned.

[30] Foreign Application Priority Data

Oct. 9, 1984 [DE] Fed. Rep. of Germany ..... 3436946

[51] Int. Cl.[5] ..... F15B 9/02; F15B 15/00

[52] U.S. Cl. ..... 91/361; 91/459; 91/465; 92/137; 92/163

[58] Field of Search ..... 92/5 R, 130 R, 163, 92/137; 91/361, 367, 426, 453, 465, 1, 459, 465; 901/37, 22; 414/4; 137/625.61, 625.64

[56] References Cited

U.S. PATENT DOCUMENTS

| | | | |
|---|---|---|---|
| 696,691 | 4/1902 | McCormack | 92/163 X |
| 763,586 | 6/1904 | Alleman | 91/465 X |
| 1,137,455 | 4/1915 | Bowster | 92/5 R |
| 1,582,022 | 4/1926 | Adams | 92/163 X |
| 2,457,930 | 1/1949 | Smith | 92/130 R X |
| 2,551,453 | 5/1951 | Mott | 92/163 X |
| 2,948,298 | 8/1960 | Gardner | 92/130 R X |
| 2,976,852 | 3/1961 | Goldring | 91/453 X |
| 2,997,066 | 8/1961 | Brinkel | 92/130 R X |
| 3,060,901 | 7/1962 | Bland et al. | 121/46.5 |
| 3,068,900 | 12/1962 | Logan et al. | 91/466 X |
| 3,233,523 | 2/1966 | Passaggio | 91/54 |
| 3,956,973 | 5/1976 | Pomplas | 92/5 R |
| 4,121,504 | 10/1297 | Nowak | 92/5 R X |
| 4,154,262 | 5/1979 | Blume et al. | 91/426 X |
| 4,422,474 | 12/1983 | Basrai et al. | 91/361 X |
| 4,493,244 | 1/1985 | Stillfried et al. | 91/459 X |
| 4,593,605 | 6/1986 | Goodell | 901/22 X |
| 4,700,610 | 10/1987 | Bauer et al. | 91/390 |

FOREIGN PATENT DOCUMENTS 2062134 6/1972 Fed. Rep. of Germany .

(List continued on next page.)

OTHER PUBLICATIONS

"Hydraulic Control Valves" Catalog 840 of Fluid Controls, Inc. 8341 Tyler Blvd., Mentor, OH. 1984. pp. INI17, ED17-22, HIC-1, Sc-1 -2.

*Primary Examiner*—Edward K. Look
*Assistant Examiner*—George Kapsalas
*Attorney, Agent, or Firm*—Poms, Smith, Lande & Rose

[57] ABSTRACT

A modular handling system is assembled from a plurality of linear drive, rotary drive, or tool modules. The linear drive used as a cylinder block with a cylindrical bore therein and cylinder heads sealing off the cylindrical bore. A pneumatically actuated piston travels within the cylindrical bore. A carriage runs on the cylinder block and is connected with the piston by means of a flexible belt attached to both the piston and the carriage and deflected by deflection rollers mounted on the cylinder heads. Cartridge-type valves are integrated into both cylinder heads for controlling displacement of the piston. One of the cartridge valves is made as a pressure-servo-valve allowing linear control of valve output pressure vs. valve operating current. The cartridge valve integrated into the opposite cylinder head may be either another pressure-servo-valve or a displacement-servo-valve allowing linear control of valve spool displacement vs. valve operating current. Thus, a stable operating point is achieved in the intersection of the characteristic curves of both valves. Further, a third or more additional valves are integrated into the cylinder heads for controlling additional modules, particularly tools attached directly on the front end side of the cylinder heads.

18 Claims, 8 Drawing Sheets

FOREIGN PATENT DOCUMENTS

| | | | |
|---|---|---|---|
| 2156696 | 5/1973 | Fed. Rep. of Germany . | |
| 2506793 | 8/1976 | Fed. Rep. of Germany . | |
| 2730933 | 7/1977 | Fed. Rep. of Germany . | |
| 2648608 | 3/1979 | Fed. Rep. of Germany . | |
| 2918294 | 5/1979 | Fed. Rep. of Germany . | |
| 3130056 | 7/1981 | Fed. Rep. of Germany . | |
| 3216693 | 5/1982 | Fed. Rep. of Germany . | |
| 3235784 | 9/1982 | Fed. Rep. of Germany . | |
| 8310037 | 4/1983 | Fed. Rep. of Germany . | |
| 3436946 | 10/1984 | Fed. Rep. of Germany . | |
| 3326098 | 2/1985 | Fed. Rep. of Germany . | |
| 3533697 | 9/1985 | Fed. Rep. of Germany . | |
| 3619473 | 6/1986 | Fed. Rep. of Germany . | |
| 1436078 | 3/1965 | France . | |
| 2454548 | 11/1980 | France . | |
| 249071 | 4/1986 | German Democratic Rep. . | |
| 57-192603 | 11/1982 | Japan | 91/465 |
| 669095 | 7/1979 | U.S.S.R. | 91/426 |
| 889149 | 6/1959 | United Kingdom . | |
| 2056692 | 3/1981 | United Kingdom | 92/5 R |

OTHER PUBLICATIONS

"PHD Automation Catalog" of PHD, Inc. Airport and Piper Drive, Fort Wayne, IN. 1988. pp. 6–2 to 6–3 and 8–2.

Yeaple, F. *Fluid Power Design Handbook*. New York: Marcel Dekker, Inc. 1984. pp. 70–77.

Schrader, L. F. "TroubleShooting the Compressed Air System," *Hydraulics and Pneumatics*, 37: No. 4. p. 41.

West German Magazine "Technische Rundschau", Issue No. 43 of 1985, Author: Wolf-Dieter Weber, Title: "Gegenwart und Zukunft der Pneumatischen Steuerungstechnik", pp. 44–49.

West German Magazine "Fluid", Issue No. 5 of 1984 Author: Prof. Backé, Title: "Elektrohydraulik in der Fertigungstechnik" pp. 21–24.

Brochure "ORIGA-schalt-Ventil", of Messrs. Iller-Pneumatik GmbH & Co. KG Steuerungstechnik Federal Republic of Germany.

10
11
12
13
14
15
16
17
18
19
20
21
22
23
24
25
26
27
28
30
31
32
33
34
35
36
37
43
50
51
52
53
54
55
56
57
58
59
60
61
II
III
$S_1$
$S_2$
$P_1$
$P_2$
ΔS
P 10a
56a
52a
55a
54a
50a
63
64
37a
$S_1$
$S_2$
$\Delta S$
$P_1$
$P_2$
Y
P
$-P_2-$

LINEAR DRIVE

CROSS REFERENCE TO RELATED APPLICATION

This application is a continuation-in-part of application Ser. No. 06/784,477 filed Oct. 4, 1985, now abondoned.

BACKGROUND OF THE INVENTION

This invention relates to modular handling systems as used for industrial applications for transporting or assembling workpieces or for performing any kinds of operations on such workpieces. Handling systems of the prior art have already used linear drive modules for performing linear displacements of further modules of the handling systems or of tools, particularly gripping tools for grasping workpieces and transporting or otherwise displacing or rotating same. In the prior art systems, linear drives have been used with pneumatic drive systems comprising a piston travelling within a cylindrical bore and being subjected to pneumatic pressure on either side of the piston, resp. The piston of prior art systems was connected on both sides with a flexible belt, travelling through pressure-tight lead-throughs of the linear drive and being returned by means of deflection rollers over the longitudinal lateral side of the linear drive. The flexible belt carried a carriage, travelling on the outside of the linear drive in an opposite direction of the piston.

However, one main drawback of prior art systems is that any module of the handling system had to be supplied individually with electrical energy, electrical control signals and operating fluid, e.g. compressed air. Thus, prior art handling systems had to be equipped with a plurality of cables, wires, and tubes. The necessity of individual wiring and tubing of all modules has reduced the freedom of displacement and rotation of the modules of the handling system.

Another drawback of prior art systems was that control valves, being arranged on the front end and rear end of a linear drive, resp., for controlling pressure on either side of the piston where subject to fluctuations resulting from variations of ambient conditions, e.g. ambient temperature. Prior art modular handling systems have used linear drives with so-called displacement-servo-valves generating a signal corresponding to the axial displacement of a valve spool and feeding back this signal to a driving stage which, in turn, operates the spool. Displacement-servo-valves of this type have an output pressure vs. operating current characteristic with the shape of a stepped function wherein output pressure is zero for low operating currents and rises quickly up to the maximum value of output pressure if a certain operating current threshold value is surpassed. When combining two such valves, the operating point of the system is defined by the intersection of two such characteristic curves, the two curves being symmetrical to each other because of the symmetrical arrangement in two cylinder heads of a linear drive. Therefore, the intersection of the two curves is within the rising portion of the stepped curve which means that the two curves intersect with an intersection angle of almost zero. If there is a fluctuation of the curves, e.g. due to fluctuation of the ambient temperature, the intersection point of the two curves will vary substantially in the ordinate direction if the curves slightly fluctuate in the abscissa direction. Therefore, output pressure of both displacement-servo-valves will vary substantially and, thus, destablize the operation of the entire handling system.

It is, therefore, a first object of the present invention to provide for a modular handling system in which the need for cabling and wiring is drastically reduced.

It is, further, another object of the invention to provide for a modular handling system in which the stability of the entire system is greatly enhanced.

SUMMARY OF THE INVENTION

The present invention overcomes the above-mentioned drawbacks of prior art systems and achieves the above-mentioned objects basically in that the need for additional tubing and wiring is reduced by integrating a third or even more additional valves into the cylinder heads of the linear drive allowing to control operation of another module or a tool that is attached to a flange surface on the cylinder head of the linear drive allowing direct control of the attached further module or gripping tool by the third or further valve without the need of making any electrical or fluid connections between the linear drive and the further units.

The object of enhancing the stability of the overall system is basically achieved by using a combination of a pressure-servo-valve and a displacement-servo-valve or a combination of two pressure-servo-valves. By using such a combination, an intersecting point of the two characteristic output pressure vs. operating current characteristics is achieved which lies well within the total operating range of the valves and in which the angle of intersection is much greater than is the case in prior art systems using two displacement-servo-valves. Therefore, the operating point of the system remains practically constant even if a fluctuation of the characteristic curves occurs.

Further, the system stability is almost enhanced when using pressure-servo-valves with an external pressure feedback comprising a pressure sensor arranged adjacent the cylindrical bore and generating an electrical signal that corresponds to the pressure prevailing on one side of the piston. Such electrical signal may be subjected to electronic control operations introducing high-order control algorithms for providing short reaction times of the handling system as a response to stepped input functions without destabilizing the operation of the entire handling system.

Other advantages and a fuller understanding of the invention may be had by referring to the following description of the preferred embodiments as applied illustratively to a modular handling system taken in conjunction with the accompanying drawings.

BRIEF DESCRIPTION OF THE DRAWINGS

The invention is illustrated in the drawings in which conventional parts are omitted or merely indicated to clarify the specification.

DETAILED DESCRIPTION OF THE PREFERRED EMBODIMENTS

Figure 10:
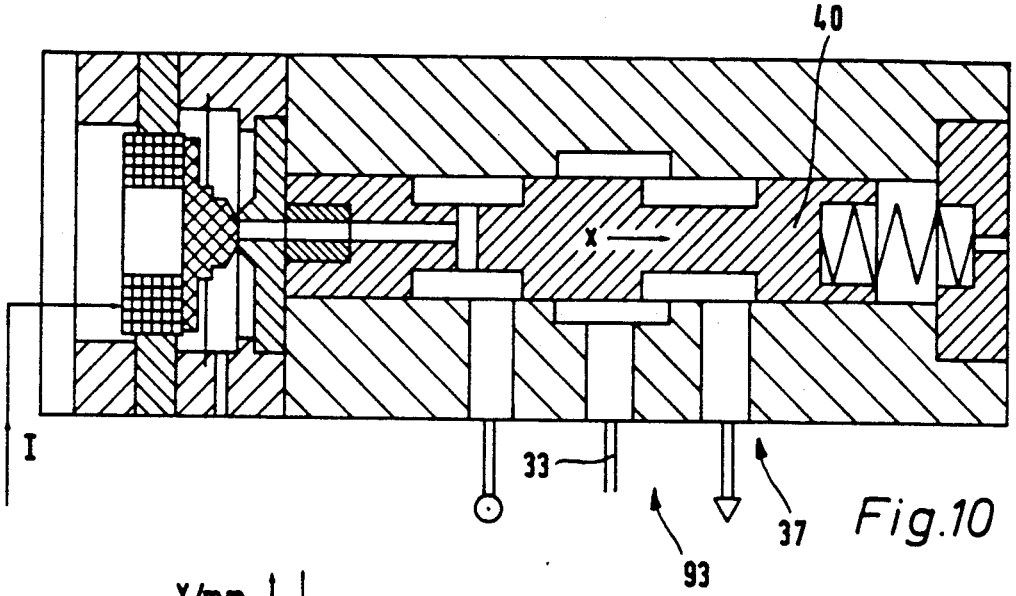
FIG. 10 a Sectional view, similar to those of FIGS. 7 and 8, of a displacement-servo-valve FIG. 11 a displacement/operating current characteristic of the displacement-servo-valve of FIG. 10.

FIG. 10 as a whole indicates a linear drive as is used e.g. in industrial handling systems. Linear drives as those which are of interest in the scope of the present invention, are normally used as combined modules, be it together with further linear drives of identical or different dimensions, be it in connection with rotary drives, with short-stroke drives or with tools, particularly gripping tools. By combining modules of the aforementioned kind, industrial handling system may be assembled which may be used for performing handling-, transportation-, assembling or other working objects in predetermined operational areas.

Figure 1:
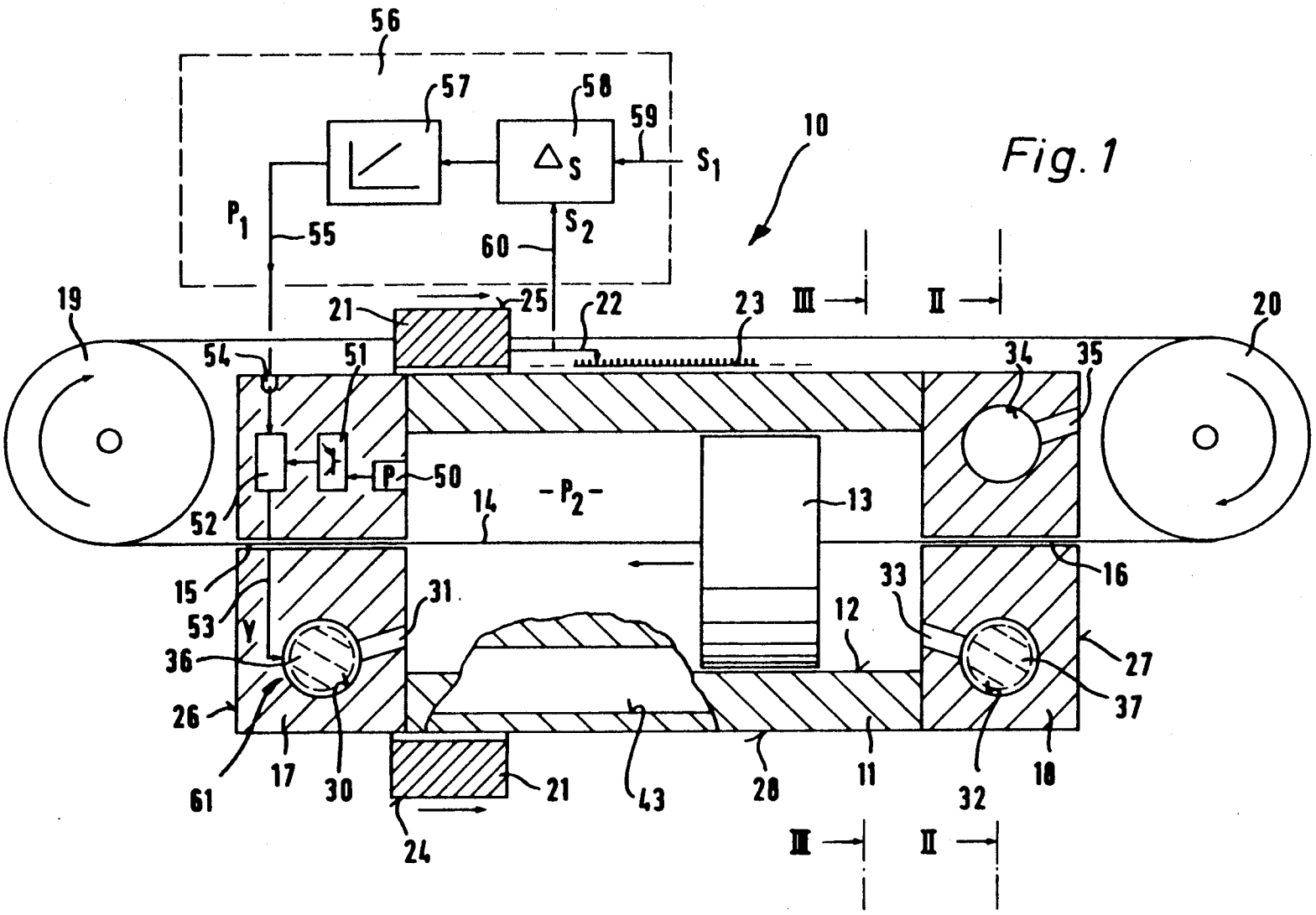
FIG. 1 a schematic side elevational view, partially as a longitudinal section, of a linear drive, together with its associate electronic control units, according to the invention.

The linear drive 10 according to FIG. 1 is provided with a cylindrical block 11 which, in turn, is provided with an axial cylindrical bore 12. Cylindrical bore 12 receives a piston 13, said piston 13 being of the type having no piston rod. On both sides of piston 13, a flexible belt is attached which is lead through pressure-tight lead-throughs 15 and 16 which are arranged in cylinder heads 17 and 18, resp. Belt 14 is, further, guided over deflection rollers 19 and 20, resp., which are arranged on both lateral sides of the cylindrical block 11. Belt 14 with its other ends is attached on both end sides of a carriage 21. Carriage 21 is arranged on an external surface of cylindrical block 11 for sliding motion in the direction of a longitudinal axis of cylindrical block 11. Cylinder heads 17 and 18, resp., provide for pressure-tight sealing of cylindrical bore 12.

Carriage 21 is coupled with a probehead 22 which is only depicted rather schematically in FIG. 1 and which cooperates with a longitudinal scale 23 at the exterior of cylindrical block 11. Elements 22 and 23, resp., allow measuring of the position of carriage 21 in the longitudinal direction of cylindrical block 11 at any time and, further, allow to transform such position into an electrical measuring signal.

Surfaces 24 and 25, resp., of carriage 21 and/or front end and rear end surfaces 26 and 27, resp., of cylinder heads 17 and 18, resp., and/or longitudinal lateral surfaces 28 of cylindrical block 11 may be used for attaching further linear drives or other drives or tools or anything similar as described at the outset of this description.

Cylinder head 17 being positioned on the lefthand side of FIG. 1 is provided with a first mounting cavity 30 which extends perpendicularly to the longitudinal axial direction of cylindrical block 11. First mounting cavity 30 is connected with cylindrical bore 12 via a duct 31. Symmetrically thereto, cylinder head 18 on the righthand side of FIG. 1 is provided with a second mounting cavity 32 which, in turn, is connected with the cylindrical bore 12 via a duct 33. Further, the right-hand side cylinder head 18 is provided with a third mounting cavity 34 from which a duct 35 extends to the righthand side front end surface 27 of cylinder head 18. mounting cavities 30, 32, and 34, resp., are dimensioned such that cartridge-type valves may fully be integrated therein. A first cartridge valve 36 is integrated in first mounting cavity 30, and a second cartridge valve 37 is integrated in second mounting cavity 32. Cartridge valves 36 and 37, resp., are used to adjust a pressure $p_2$ on both sides of piston 13, as explained in full detail below, for having piston 13 running in cylindrical bore 12, as desired. A third cartridge valve may be integrated into third mounting cavity 34 to supply fluid to a further module, particularly a gripping tool or a short-stroke drive that is attached directly on front end surface 27. Thus, by using e.g. a switching valve in third mounting cavity 34, the said gripping tool or short-stroke drive may be controlled without the need of further external wiring or tubing.

For the reasons explained above, cartridge valves 36 and 37, resp., are made as servo-valves, whereas a third cartridge valve to be integrated into third mounting cavity 34 is preferably made as a switching valve.

It should be mentioned here that within the scope of the present invention, compressed air is preferably used as actuating fluid.

Figure 2:
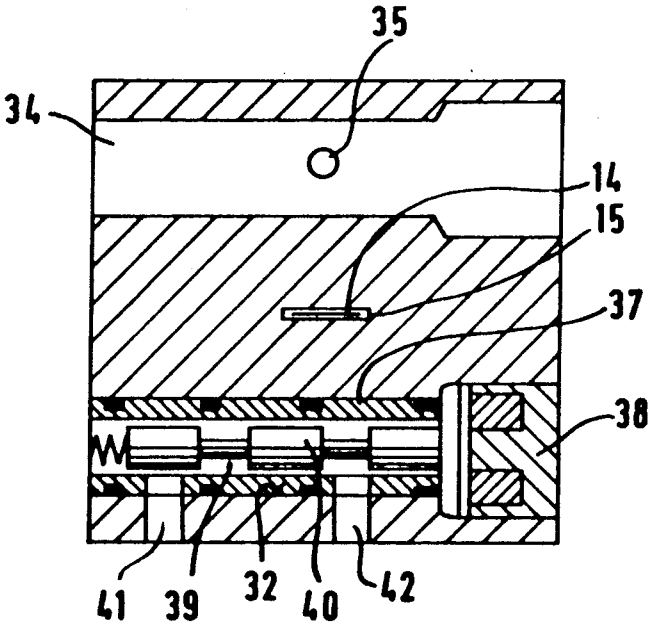
FIG. 2 a sectional view along the line II—II of FIG. 1.

As can further be taken from FIG. 2, second cartridge valve 37, in extremely schematic representation, comprises an electrically operated driving stage 38 and, further, a main stage 39, actuated by said driving stage 38. A spool 40 is provided to connect duct 31 (not shown in FIG. 2) alternately with an inlet 41 or an outlet 42 to either allow pressure fluid to flow into cylindrical bore 12 or to be discharged therefrom, as will be fully explained below.

Figure 3:
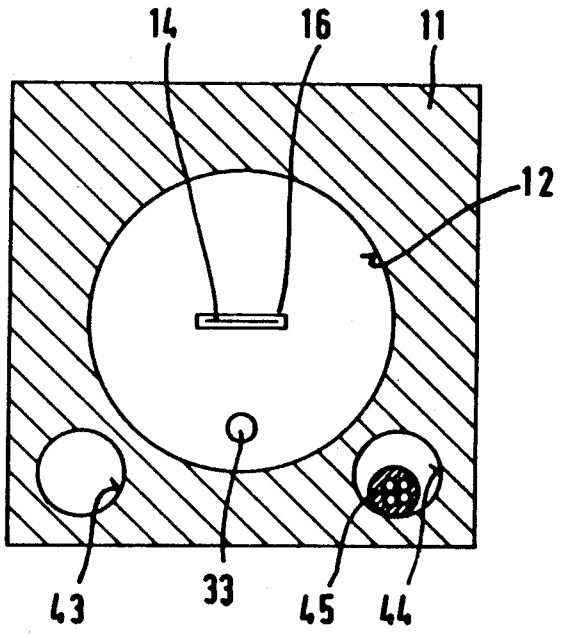
FIG. 3 a sectional view along the line III—III of FIG. 1.

FIG. 3, additionally, shows that two longitudinal ducts 43 and 44, resp., extend in an axial direction through cylindrical block 11. Longitudinal ducts 43 and 44, resp., are used for internal tubing or wiring in order to have a central connector for electrical signals, for electrical energy, or for the fluid just on one of cylinder heads 17 or 18, resp., and to distribute electrical signals, electrical energy or fluid internally over longitudinal ducts 43 and 44, resp., to the other cylinder head, resp. In this way, the need for additional external wiring and tubing is drastically reduced.

In the embodiment depicted in FIG. 3, first longitudinal duct 43 is used for guiding a fluid, whereas second longitudinyl duct 44 is used to receive a cable 45. It goes, however, without saying that second longitudinal duct 44 in addition to receiving cable 45 may be used for transporting a fluid.

According to the invention, linear drive 10 is provided with at least one cartridge valve 36 or 37, resp., being made as a pressure-servo-valve.

Pressure-servo-valves are valves of the type in which the fluid pressure at the outlet of the valve is fed back to the input of the valve to influence axial motion of the valve spool. By thus feeding back outlet pressure, presurre-servo-valves may be used to precisely adjust outlet pressure by adjusting an input operating current of the valve solenoid, and outlet pressure is normally linearly dependent on input operating current, as will be fully explained below.

In order to give the arrangement on the lefthand side of FIG. 1 an operational characteristic of the pressure-servo-type, the embodiment of FIG. 1 in its lefthand cylinder head 17 is provided with a pressure sensor 50, the sensing surface of which is arranged adjacent to cylindrical bore 12. Thus, pressure sensor 50 generates an electrical signal which corresponds to pressure $p_2$ within cylindrical bore 12. Such signal is amplified by means of a preamplifier 51 which, too, is integrated into cylinder head 17. The output of preamplifier 51 is connected to a control stage 52 which is also integrated into cylinder head 17 in the embodiment, as shown in FIG. 1. A cable 53 connects an output of control stage 52 with an operating solenoid of first cartridge valve 36. A second input of control stage 52 is connected to a plug connector 54 which represents a detachable electrical connection at the exterior surface of cylinder head 17.

Plug connector 54 is connected to an output 55 of an external control unit 56 that may be housed within a control console of the entire industrial handling system.

External control unit 56 is provided with a transforming stage 57 as well as a subtraction stage 58, connected in series with transforming stage 57. A first input 59 of subtraction stage 58 is fed with a desired displacement value $s_1$, whereas its second input 60 is fed with an axial displacement signal $s_2$. The axial displacement signal $S_2$ is generated by probing head 22 in connection with longitudinal scale 23, as explained above.

The control unit for pressure $p_2$ in cylindrical bore 12 of FIG. 1 operates as follows:

Subtraction stage 58 over its first input 59 is provided with a desired value $S_1$ for a position which piston 13 should take relatively to cylindrical block 11. Such desired value may, e.g., correspond to a desired displacement of a gripping element that is attached to surface 24 of carriage 21.

Subtraction stage 58 generates a difference $\Delta S$ between desired value $S_1$ and actual value $S_2$, as is measured at any time by longitudinal measuring unit 22, 23. Difference $\Delta S$ is forwarded to transforming stage 57 which correlates a desired output pressure value $P_1$ to the said difference $\Delta S$ by using a respective characteristic curve or table to convert $\Delta S$ into $P_1$. The table or characteristic contained in transforming stage 57 may be defined at will within broad ranges, as may be the need for specific application cases.

Desired pressure value $P_1$ is now fed to control stage 52 which, on the other handside, is provided with an actual pressure value $P_2$, being an electrical signal and corresponding to the actual pressure $P_2$ in cylindrical bore 12. From these two input signals, control stage 52 generates an actuating signal Y for the operating solenoid of first cartridge valve 36.

By actuating first cartridge valve 36, its spool is displaced such that e.g. that portion of cylindrical bore 12 being on the lefthand side of piston 13 in FIG. 1 is released from pressure such that piston 13 is running to the left, as indicated in FIG. 1 by arrows. In view of belt 14 being provided with axial tension, deflection rollers 19 and 20 are rotated clockwise and carriage 21 runs in opposite direction to piston 13 on cylindrical block 11, i.e. in a direction to the righthand side of FIG. 1. The axial position of carriage 21 is measured at any time by longitudinal measuring arrangement 22, 23 and is fed to external control unit 56 until arrival of carriage 21 at its desired position $S_1$ is detected. At this moment, an equal pressure $p_2$ is established within cyhlindrical bore 12 on both sides of piston 13 such that piston 13 and, hence carriage 21 are immediately set still.

Figure 4:
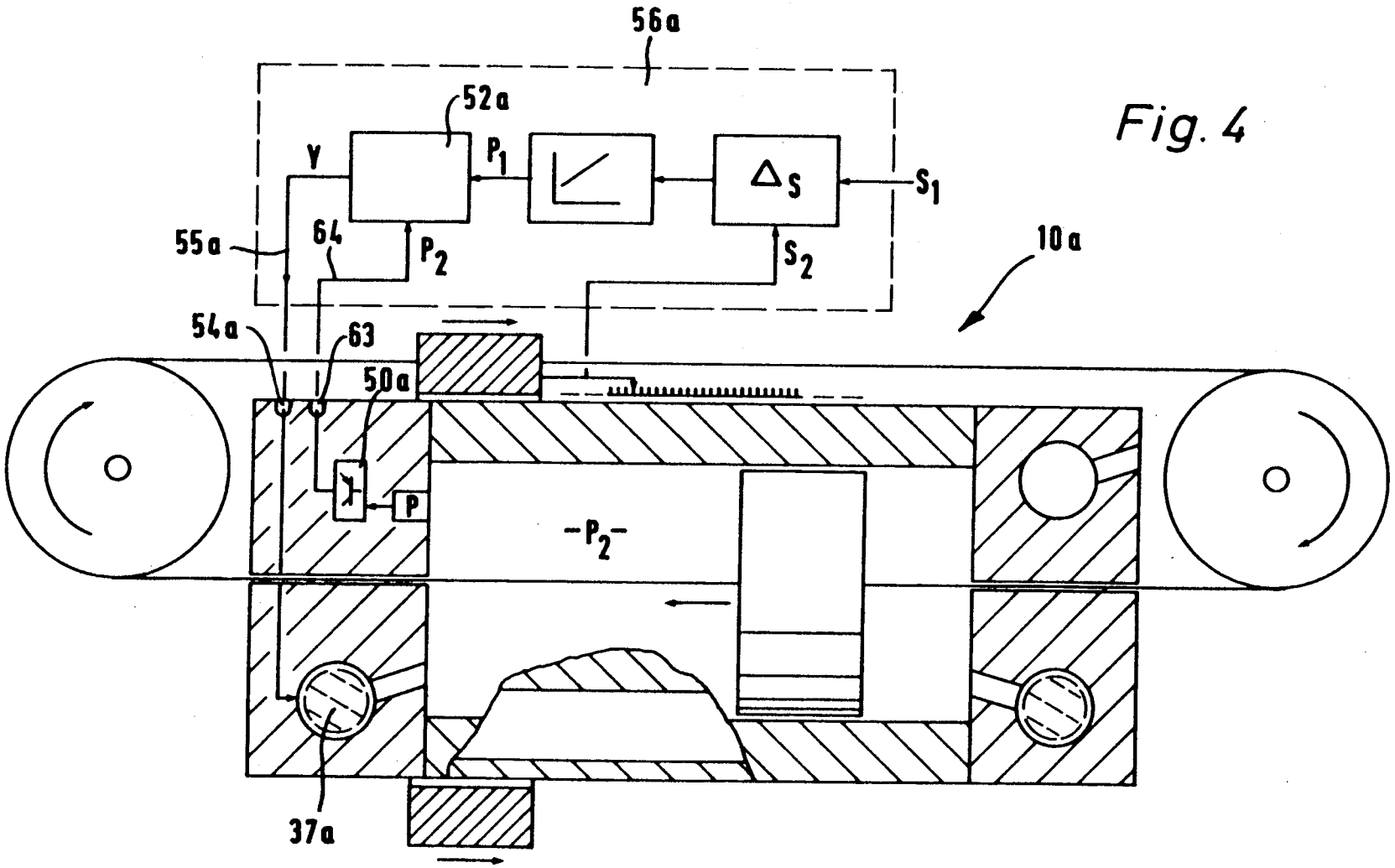
FIG. 4 a side elevational view, similar to that of FIG. 1, for further embodiment of the invention.

The embodiment of FIG. 4 is different from that of FIG. 1 in so far as electrical signal $P_2$, corresponding to internal pressure $p_2$ within cylindrical bore 12 is fed to control stage **52*a* from the output of preamplifier 50*a* via a second plug connector 63 and a cable 64, control stage 54*a* being arranged in this embodiment within external control unit 56*a*. Actuating signal Y of control stage 52*a* is forwarded from output 55*a* of external control unit 56 via a cable and via first plug connector 54*a* to first cartridge valve 37*a*. It is, thus, possible to modify control operation of control stage 52*a* without additional long cables between external control unit 56*a* and linear drive 10*a*** and to introduce further operational parameters, if need arises.

Figure 5:
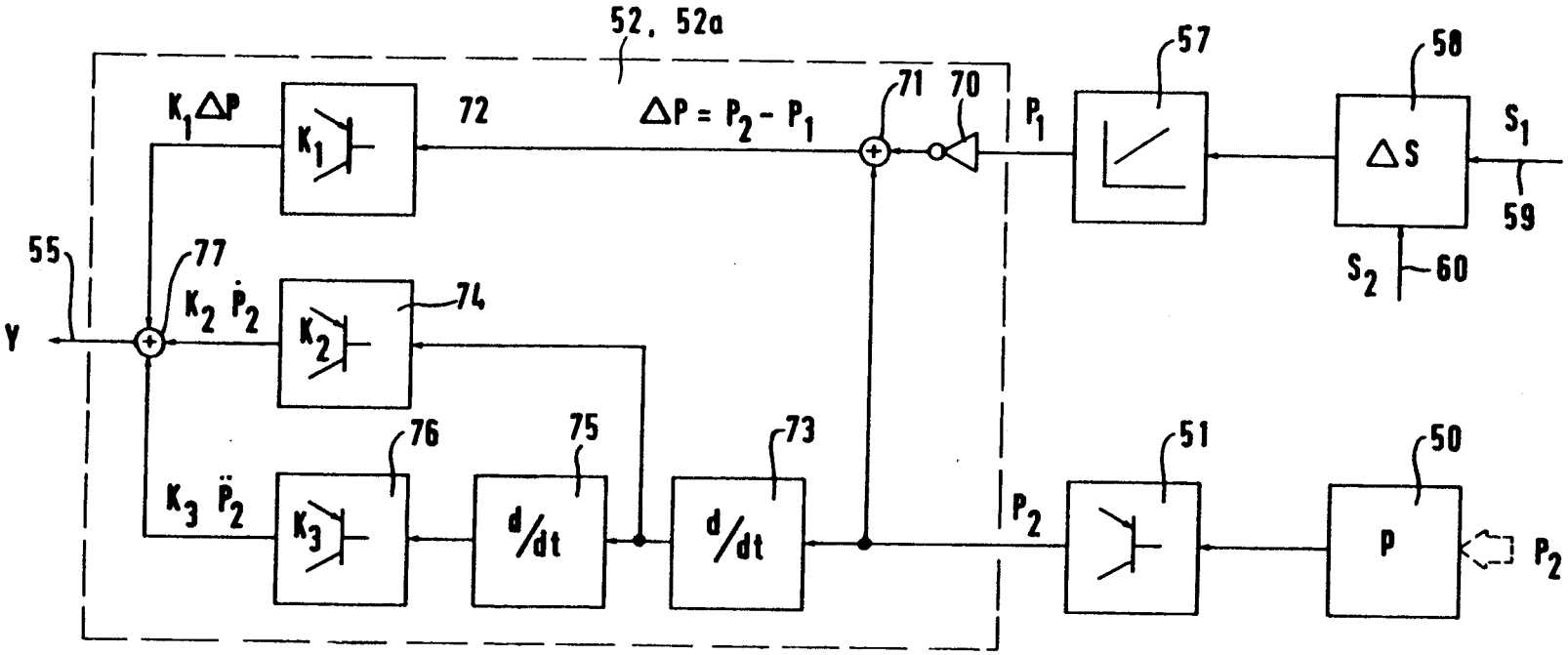
FIG. 5 a schematic block diagram of a control unit as used according to the invention together with a linear drive.

FIG. 5 shows a block diagram of a circuit which, principally, is independent of whether control stage 52 is integrated into cylinder head 17 or is arranged as control unit **52*a* in external control unit 56*a***.

The desired pressure value $P_1$ is fed to control stage 52 having an inverter 70 at its input in which the polarity of the signal is inverted. From inverter 70, the signal is fed to a first summing stage 71 which, at its second input, is provided with an electrical signal $P_2$ that corresponds to the actual pressure value. At the output of first summing stage 71, a differential signal $\Delta P = P_2 - P_1$ is present. This differential value is fed to a first weighing stage 72 in which differential value $\Delta P$ is multiplied with a first constant $K_1$. Constant $K_1$ may be greater or smaller than unity and may be of positive or negative polarity. Weighing stage 72, if constant $K_1$ is smaller than unity may be a potentiometer whereas, if constant $K_1$ is greater or smaller than unity, may be made as an amplifier. Thus, a signal $K_1 \Delta P$ is present at the output of first weighing stage 72.

Electrical signal $P_2$ corresponding to the actual pressure value is, further, directly fed to a first differentiating stage 73 which generates the first derivative of signal $P_2$. Such first derivative is fed to a second weighing stage 74 which is made similar to first weighing stage 74 and is used to multiply the first derivative of signal $P_2$ with a constant $K_2$.

The output of first differentiating stage 73 is, further, connected to an input of a second differentiating stage 75, at the output of which the second derivative of electrical signal $P_2$ as corresponds to the actual pressure value is present. The second derivative is fed to a third weighing stage 76 for multiplication with a constant $K_3$.

The outputs of weighing stages 72, 74, and 76, resp., are combined in a second summing stage 77, the output of which is, simultaneously, the output 55 of control stage 52. The actuating signal Y at output 55, therefore, corresponds to the following equation:

$$Y=K_1\Delta P+K_1P_2+K_3P_2$$

Figure 6:
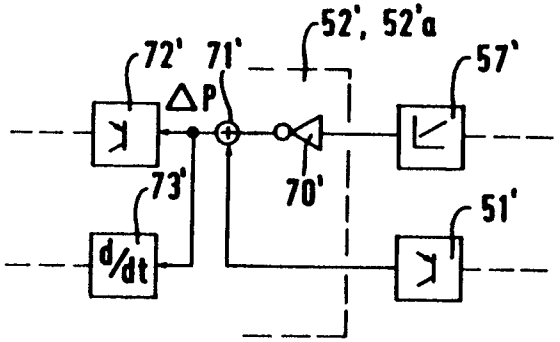
FIG. 6 a further embodiment, slightly modified with respect to the block diagram of FIG. 5.

In a modified embodiment of control stage 52' as shown in FIG. 6, both the first weighing stage 72' and first differentiating stage 73' are fed with differential value Δ P, whereas the remainder of the circuitry is identical to that of FIG. 5.

Figure 7:
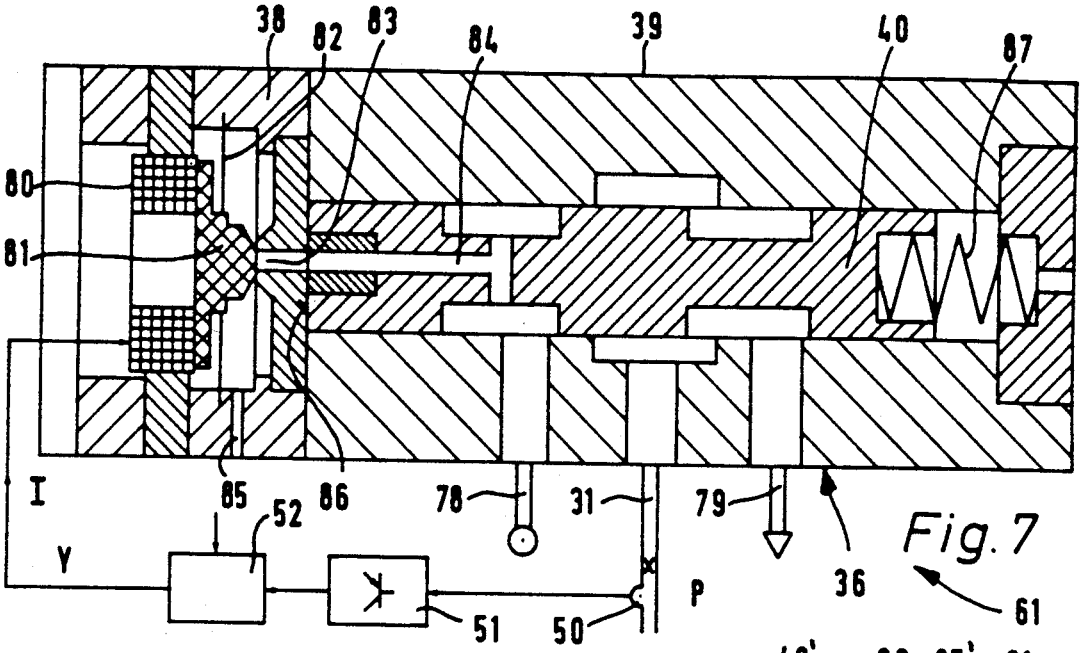
FIG. 7 a sectional view of a pressure-servo-valve, as can be used for a linear drive within the scope of the present invention.

FIG. 7 shows a sectional view of pressure-servo-valve 61 in an embodiment with external pressure feedback as shown in FIGS. 1 and 2.

Cartridge valve 36 at its supply side is connected to a fluid inlet 78 as well as to a fluid outlet 79, whereas its output side is connected to duct 31. Duct 31 or its transition into cylindrical bore 12 is provided with pressure sensor 50 which generates actuating signal Y via elements 51 and 52, resp., said actuating signal Y resulting in an operating current I in connection with the internal resistance value of operating solenoid of cartridge valve 36.

Cartridge valve 36 is provided with a solenoid 80 which carries a baffle plate 81. Solenoid 80 and baffle plate 81 are suspended by means of a membrane such that baffle plate 81 together with solenoid 80 may be elastically displaced in an axial direction within certain limits in dependance of the intensity of operating current I.

If solenoid 80 is not actuated, baffle plate 81 under the resilient action of membrane 82 rests on a nozzle 83. Nozzle 83 is connected to a duct 84, extending axially through spool 40. An annular tee-slot connects duct 84 with inlet 78 if spool 40 is in the initial position as shown in FIG. 7. In this position, outlet duct 31 is connected to outlet 79 via appropriate annular tee-slots. I.f pressure is generated in duct 84 via inlet 78, spool 40 is displaced to the righthand side against the action of a spring 87, as spool 40 with a radially extending surface 86 is displaced from a nozzle member comprising nozzle 83. If baffle plate 81 is displaced from nozzle 83, because solenoid 80 is actuated, fluid flows into the cavity between membrane 82 and nozzle member via duct 84 and, further, via a further duct 85 into ambient atmosphere. In this way, deflection force of spool 40 is reduced, and spool 40, thus, returns to the lefthand side under the action of spring 87.

In such a way, position of spool 40 and, hence, overlapping of inlet and outlet ducts may be adjusted in dependance of pressure p in duct 31 and cylindrical bore 12, resp., such that a desired pressure value p may be adjusted reproducibly by variation of operating current I .

Figure 8:
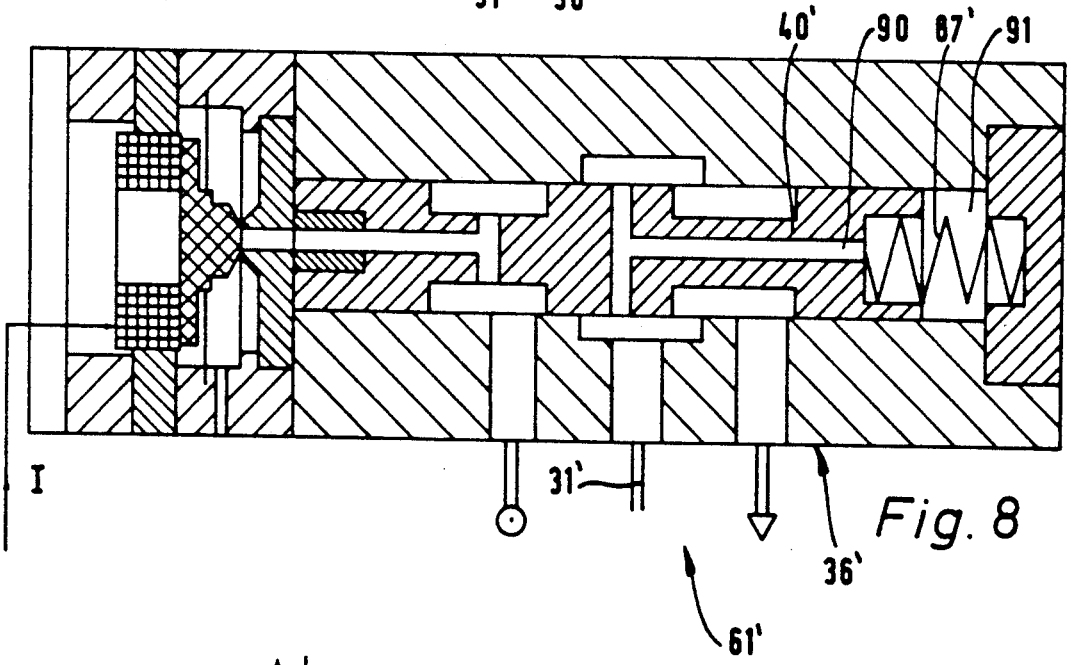
FIG. 8 a view, similar to that of FIG. 7, but for a further embodiment with mechanical pressure feedback.

Whereas pressure feedback is achieved by external elements 50, 51, and 52, resp., with the embodiment of FIG. 7, a further embodiment, depicted in FIG. 8, shows an internal pressure feedback. Spool 40' is provided with a further axial duct 90 that connects outlet duct 31' to the righthand front surface of spool 40' in FIG. 1. Cavity 91, receiving spring 87', is sealed in a pressure-tight manner with the embodiment of FIG. 8, whereas the embodiment of FIG. 7 was provided with a vent bore into the ambient atmosphere in order not to handicap displacement of spool 40 into the righthand direction of FIG. 7.

In the embodiment of FIG. 8, therefore, a feedback pressure is exerted on the righthand side of spool 40', whereas from the lefthand side of spool 40 an input pressure is active as explained above with respect to the FIG. 7 embodimdent.

Figure 9:
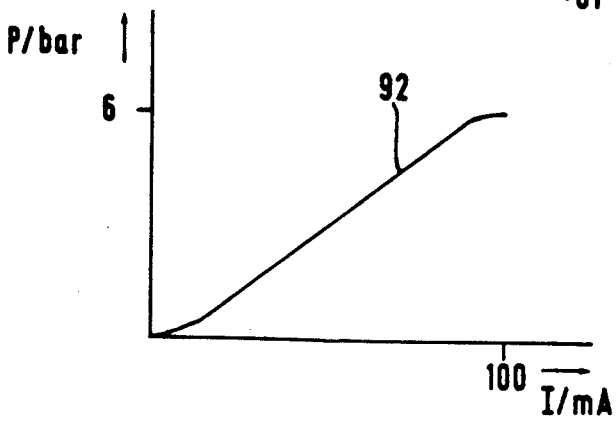
FIG. 9 a schematic pressure/operating current characteristic for pressure-servo-valves accordig to those of FIGS. 7 or 8.

FIG. 9 shows a characteristic 92 as is typical for a pressure-servo-valve 61 according to FIG. 7 of 62' according to FIG. 8.

The adjustable output pressure p, varying between 0 and 6 bar (0 and 87 psi), is depicted versus operating current, varying between 0 and 100 mA in the described embodiment. There is a quasi linear relation between output pressure p and operating current I having a gradient of about 0.06 bar/A (0.87 psi/A).

For comparison purposes, FIG. 10 shows a displacement-servo-valve 93 as corresponds to cartridge valve 37 in the embodiment of FIG. 7.

Figure 11:
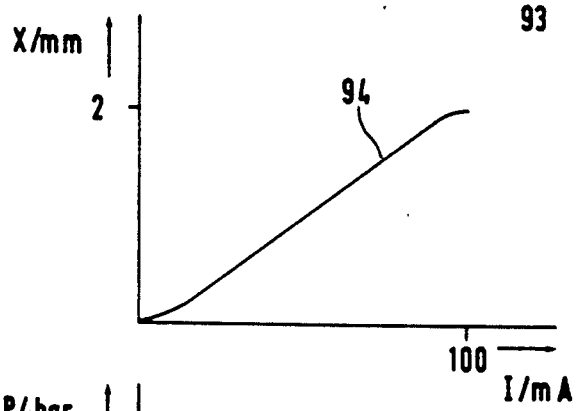

Because of the non-existing pressure feedback, a characteristic 94 according to FIG. 11 is achieved wherein displacement x versus operating current I is shown. If operating current, again, is varied between 0 and 100 mA, a variation in displacement x of spool 40 results between, say, 0 and 2 mm (0.079 inch) with a practically ideal linear relationship.

Figure 12:
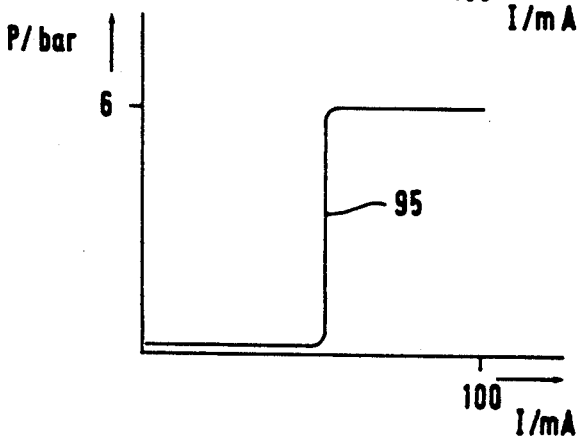
FIG. 12 a pressure/operating current characteristic of the displacement servo-valve of FIG. 10.

A displacement-servo-valve, therefore, is normally used to set spool displacement in accordance to a predetermined operating current I. Thus, the flow rate at the output of the valve may be adjusted simultaneously, such flow rate being e.g. 500 1/min (132 U.S. gallons per minute). If, however, displacement-servo-valve 93 operates on a closed cavity, as for example cylinder bore 12, a characteristic 95 is achieved as shown in FIG. 12 for the valve output pressure p versus operating current I. Characteristic 95 clearly shows that wshen increasing displacement of spool 40 continuously, output pressure p rises quite sharply from 0 to its maximum value, e.g. 6 bar (87 psi), as soon as overlapping of spol 40 results in a direct connection of the inlet duct at the output duct of cartridge valve 37.

Figure 13:
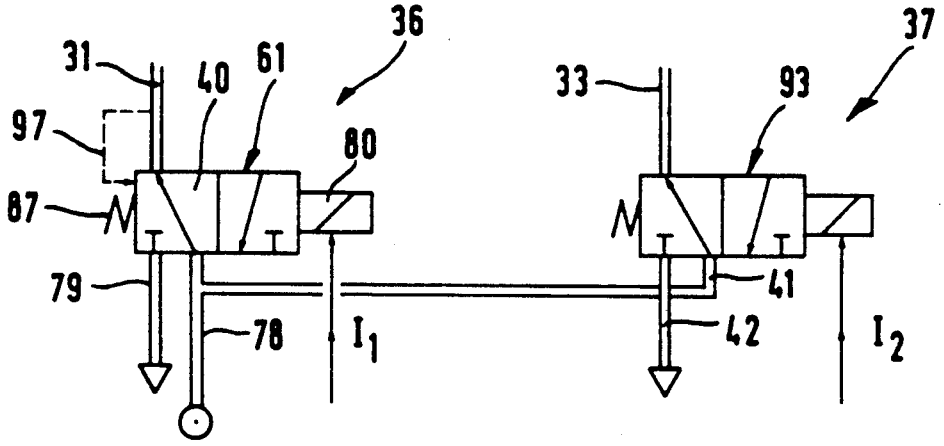
FIG. 13 a schematic fluid circuit diagram for illustrating a first circuitry in connection with a linear drive according to the invention.
Figure 14:
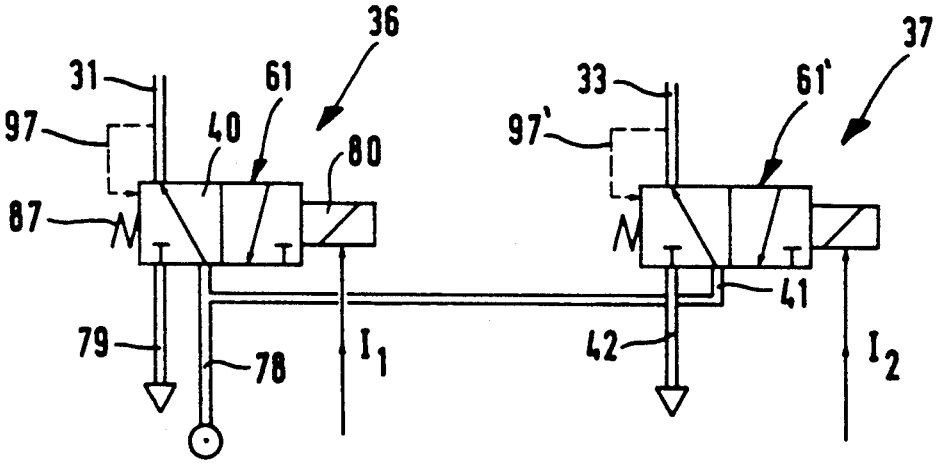
FIG. 14 a circuit diagram, similar to that of FIG. 13, for another embodiment of the invention.

From the various valve embodiments as described above in detail, and as can be used for linear drives of the kind which are of interest in the scope of the present invention, the following two circuit options result, as are shown schematically in FIGS. 13 and 14.

In the embodiment of FIG. 13, a pressure-servo-valve 61 is used as a first cartridge valve 36 in first mounting cavity 30, as was explained in detail above with respect to the FIG. 7 embodiment and as is also shown in FIGS. 1 and 4. On the other handside, a displacement-servo-valve 93 is used as a second cartridge valve 37 in second mounting cavity 32, as was explained in detail as such with respect to the FIG. 10 embodiment. 97 represents an external pressure feedback of pressure-servo-valve 61 as was explained in detail with respect to elements 50 through 52 in the FIG. 7 embodiment.

FIG. 13, further, shows that inlets 46 and 78 are directly interconnected as is made possible e.g. by means of first longitudinal duct 43.

In contrast, FIG. 14 shows a combination in which the details with respect to first mounting cavity 30 are identical to those of FIG. 13 whereas in second mounting cavity 32 a second pressure-servo-valve 61' with feedback 97' is used as a second cartridge valve 37.

Figure 15:
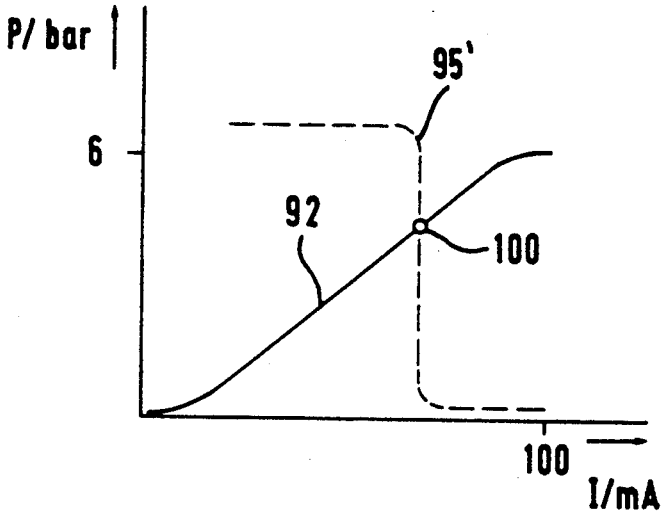
FIG. 15 an operating diagram of two characteristics for illustrating the operating point of the embodiment according to FIG. 13.
Figure 16:
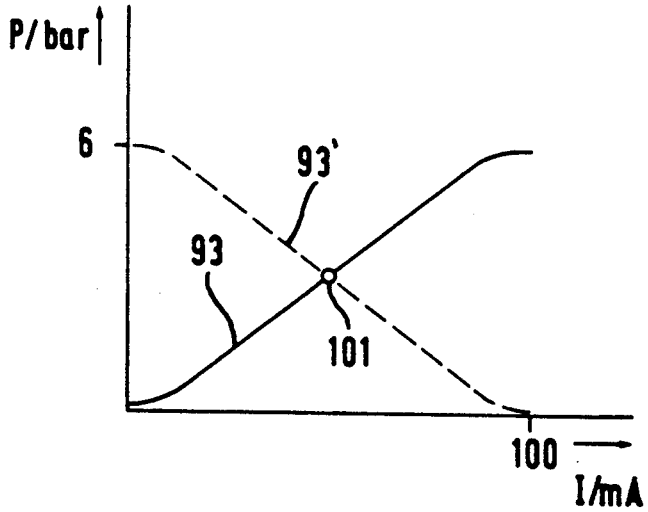
FIG. 16 a diagram similar to that of FIG. 15 for the embodiment of FIG. 14.

The two embodiments shown in FIGS. 13 and 14, resp., result in operational characteristics as shown in FIGS. 15 and 16, resp.

FIG. 15 illustrates the FIG. 13 circuit embodiment. In this case, a characteristic 92 of pressure-servo-valve 61 is combined with characteristic 95' of displacement-servo-valve 93, bearing in mind that in view of the opposite direction action of valves 61 and 93, resp., characteristic 95' is symmetrical to characteristic 95 of FIG. 12.

As can clearly be seen from FIG. 15, an operating point 100 results as an intersection of characteristics 92 and 95', resp., the operating point 100 lying within the operational range of valves 61 and 93, resp., i.e. within the operating current range between 0 and 100 mA and within the pressure range between 0 and 6 bar (87 psi). Even if characteristics 92 and 95' would slightly fluctuate, operating point 100 would basically remain constant. This is a substantial difference with respect of prior art where it was customary to combine two displacement-servo-valves with each other. In that case, two characteristics of the kind of characteristic 95 and 95' were intersected wherein the intersection of these two stepped functions was lying in the range of the relatively steep rising flange of the characteristics. Therefore, if the characteristics fluctuated even slightly with respect to the abscissa, a considerable variation of the operating point in the ordinate direction came out.

Finally, FIG. 16 illustrates the case of the FIG. 14 circuit embodiment.

In this case, two characteristics 93 and 93' of two pressure-servo-valves 61 and 61', respe., are intersected with the result of an operating point 101 shown in FIG. 16 and lying well within the operating range of valves 61 and 61' with a limited gradient of characteristics 93 and 93', resp. in the operating point 101.

In the aforementioned cases of FIG. 15 and 16, resp., the gradient or slope of characteristics 92, 95'; 93, 93' is in the order of about 0.06 bar/A (0.87 psi/A).

Servo-valves as used in connection with the present invention typically operate with low control power of e.g. 1.5 W, actuating, at the same time, high output powers of the linear drive of e.g. 1 kW. It goes, however, without saying that these and any other operational parameters as mentioned in the preceding description are to be considered only as examples which do not limit the scope of the present invention. If smaller or bigger linear drives are requested, the size and the operational parameters of the valves used would vary accordingly, as is well know in the art per se.

We claim:

1. A modular handling system having a first module being made as a linear drive for displacing along one axis of a second module, said linear drive comprising:

a cylinder block with a cylindrical bore extending along said one axis and having first and second cylinder heads sealing off said cylindrical bore in said cylinder block at its end faces;

a piston having first and second lateral sides aand being accommodated in said cylindrical bore and adapted to travel along said bore;

a carriage running on said cylinder block along said one axis;

said piston being connected on both lateral sides solely to a flexible elongated member, said flexible elongated member passing through pressure-tight lead-throughs in said first and second cylinder head and being returned by deflection rollers and then connected with rear end and front end sides, respectively, of said carriage, whereby said carriage travels along said cylinder block in the opposite direction of said when said piston is actuated to travel;

said first and second cylinder head being provided with elongate first and second mounting cavities, respectively, to fully recieve first and second cartridge-type valves, respectively, said second cylinder head being further provided with a third mounting cavity for receiving a third cartridge-type valve, said first, second and third valves being arranged transversely to said one axis;

said first, second and third valves having each first input connecting means for feeding electrical control signals to a driving stage, further having each second input connecting means for feeding a pressurized fluid to a main stage, operated and displaced by said driving stage and having each output connecting means to which alternatively said pressurized fluid is fed or an exhaust line is connected according to displacement of said main stage;

said first and second valves having each their output connecting means connected via a first duct and a second duct, respectively, to opposite ends of said cylindrical bore for feeding, in one operational position, said pressurized fluid into a first portion of said cylindrical bore on said one lateral side of said piston by means of said first valve and for exhausting said pressurized fluid, respectively from a second portion of said cylindrical bore on said other lateral side of said piston by means of said second valve to thereby displace said carriage in one direction;

said third valve having its output connecting means connected via a third duct to a flange surface of said second cylinder head, said flange surface being adapted for connection with said second module controlled by said third valve;

a linear displacement measuring device, cooperating with said flexible member to measure a first signal representing the axial position of said piston along said one axis, said measuring device cooperating with an electronic control circuit, said unit receiving a predetermined second signal representing a reference position valve and supplying said electrical control signal to said first input connecting means of said first and second valves in dependence on a difference between said first and second signals; wherein said first valve is a pressure-servo-valve having first valve control means for feeding back a signal corresponding to a pressure prevailing at said first valve output connecting means for operating said first valve main stage and wherein, further, said second valve is a displacement-servo-valve having second valve control means for feeding back a signal corresponding to a displacement of a second valve spool of said second valve main stage for operating said second valve main stage, said second valve control means being designed such that output preassure v. operating current characteristics of said first and second valve intersect with the output pressure/operating current operational range of said first and second valve.

2. The modular handling system of claim 1 in which said first valve control means comprises a pressure sensor arranged adjacent said cylindrical bore and being connected to provide an actual pressure valve signal to a first valve control stage, said first valve control stage receiving a desired pressure valve signal and being connected with its output to said first valve driving stage.

3. The modular handling system of claim 2 in which said first valve control stage comprises:

a subtraction stage for subtracting said desired pressure valve signal from said actual pressure valve signal to generate a differential signal;

a first weighing stage for multiplying said differential signal by a first constant;

a first differentiating stage for generating the first derivative of said actual pressure valve signal;

a second weighing stage for multiplying said first derivative by a second constant;

a second differentiating stage connected to an output of said first differentiating stage for generating the second derivation of said actual pressure valve stage;

a third weighing stage for multiplying said second derivative by a third constant;

a summing stage for summing up output signals of said first, second and third weighing stage, said summing stage being connected to said first valve driving stage.

4. The modular handling system of claim 2 in which said second module is a short stroke linear drive having linear displacement means connected to said third duct.

5. The modular handling system of claim 2 in which said second module is a gripping tool having gripping tool jaws actuating means connected to said third duct.

6. The modular handling system according to claim 2 in which said first valve is a pressure-servo-valve having first valve control means for feeding back a signal corresponding to a pressure prevailing at said first valve output connecting means for operating said first valve main stage and wherein, further, said second valve is another pressure-servo-valve having second valve control means for feeding back a signal corresponding to a pressure prevailing at said second valve output connecting means for operating said second valve main stage, said first valve control means and second valve control means, respectively, being designed such that output pressure v. operating current characteristics of said first and second valve intersect within the output pressure/operating current operational range of said first and second valve.

7. The modular handling system of claim 6, wherein said first valve control means and said second valve control means comprise a pressure sensor arranged adjacent said cylindrical bore and being connected to provide an actual pressure valve signal to a first valve control stage and second valve control stage, respectively, said first valve control stage and said second valve control stage each receiving a desired pressure valve signal and being connected with their outputs to said first valve driving stage and said second valve driving stage, respectively.

8. The modular handling system of claim 6 in which either of said first valve control stage and said second valve control stage comprises:

a subtraction stage for subtracting said desired pressure valve signal from said actual pressure valve signal to generate a differential signal;

a first weighing stage for multiplying said differential signal by a first constant;

a first differentiating stage for generating the first derivative of said actual pressure valve signal;

a second weighing stage for multiplying said first derivative by a second constant;

a second differentiating stage connected to an output of said first differentiating stage for generating the second derivative of said actual pressure valve stage;

a summing stage for summing up output signals of said first, second and third waiting stage; wherein said summing stages of said first valve control stage and said second valve control stage are connected to said first valve driving stage and said second valve stage, respectively.

9. A modular handling system having a first module being made as a linear drive for displacing along one axis a second module, said linear drive comprising:

a cylinder block with a cylindrical bore extending along said one axis and having first and second cylinder heads sealing off said cylindrical bore in said cylinder block at its end faces;

a piston having first and second lateral sides and being accommodated in said cylindrical bore and adapted to travel along said bore;

a carriage running on said cylinder block along said one axis;

said piston being connected on both lateral sides solely to a flexible elongated member, said flexible elongated member passing through pressure-tight lead-throughs in said first and second cylinder head and being returned by deflection rollers and then connected with rear end and front end sides, respectively, of said carriage, whereby said carriage travels along said cylinder block in the opposite direction of said piston when said piston is actuated to travel;

said first and second cylinder head being provided with elongate first and second mounting cavities, respectively, to fully receive first and second cartridge-type valves, respectively, said first and second valves being arranged transversely to said one axis;

said first and second valve having each first input connecting means for feeding electrical control signals to a driving stage, further having each second input connecting means for feeding a pressurized fluid to a main stage, operated and displaced by said driving stage and having each output connecting means to which alternatively said pressurized fluid is fed or an exhaust line is connected according to displacement of said main stage;

said first valve being a pressure-servo-valve having first valve control means for feeding back a signal corresponding to a pressure prevailing said first valve output connecting means for operating said first valve main stage;

said second valve being a displacement-servo-valve having second valve control means for feeding back a signal corresponding to a displacement of a spool of said second valve an stage for operating said second valve main stage;

said first valve control means and said second valve control means being designed such that output pressure v. operating current characteristics of said first and second valve intersect within the output pressure/operating current operational range of said first and second valve;

said first and second valves having each their output connecting means connected via a first duct and a second duct, respectively, to opposite ends of said cylindrical bore for feeding, in one operational position, said pressurized fluid into a first portion of said cylindrical bore on said one lateral side of said piston by means of said first valve and for exhausting said pressuirzied fluid, respectively, from a second portion of said cylindrical bore on said other lateral side of said piston by means of said second valve to thereby displace said carriage in one direction;

a linear displacement measuring device, cooperating with said flexible elongated member to measure a first signal representing the axial position of said piston along said one axis, said measuring device cooperating with an electronic control circuit, said unit receiving a predetermined second signal representing a reference position valve and supplying said electrical control signals to said first valve input connecting means and said second valve input connecting means, respectively, in dependence on a difference between said first and second signals.

10. The modular handling system of claim 9 in which said second module is a short-stroke linear drive having linear displacement means.

11. The modular handling system of claim 9 in which said second module is a gripping tool jaws actuating means.

12. The modular handling system of claim 9 in which each of said first control means comprises a pressure sensor arranged adjacent said cylindrical bore and being connected to provide an actual pressure valve signal to a first valve control stage and a second valve control stage, respectively, said control stages receiving a desired pressure valve signal and being connected with their outputs to said first valve driving stage and said second valve driving stage, respectively.

13. The modular handling system of claim 12 in which either of said first valve control stage and said second valve control stage comprises:

a subtraction stage for substracting said desired pressure valve signal from said actual pressure valve signal to generate a differential signal;

a first weighing stage for multiplying said differential signal by a first constant;

a first differentiating stage for generating the first derivative of said actual pressure valve signal;

a second weighing stage for multiplying said first derivative by a second constant;

a second differentiating stage connected to an output of said first differentiating stage for generating the second derivative of said actual pressure valve stage;

a third weighing stage for multiplying said second derivative by a third constant;

a summing stage for summing up output signals of said first, second and third weighing stage; wherein said summing stages of said first valve control stage and said second valve control stage are connected to said first valve driving stage and said second valve driving stage, respectively.

14. A modular handling system having a first module being made as a linear drive for displacing along one axis a second module, said linear drive comprising:

a cylinder block with a cylindrical bore extending along said one axis and having first and second cylinder heads sealing off said cylindrical bore in said cylinder block at its end faces;

a piston having first and second lateral sides and being accommodated in said cylindrical bore and adapted to travel along said bore;

a carriage running on said cylinder block along side one axis;

said piston being connected on both lateral sides solely to a flexible elongated member, said flexible elongated member passing through pressure-tight lead-throughs in said first and second cylinder head and being returned by deflection rollers and then connected with rear end and front end sides, respectively, of said carriage, whereby said carriage travels along said cylinder block in the opposite direction of said piston when said piston is actuated to travel;

said first and second cylinder head being provided with elongate first and second mounting cavities, respectively, to fully receive first and second cartridge-type valves, respectively, said first and second valves being arranged transversely to said one axis;

said first and second valve having each first input connecting means for feeding electrical control signals to a driving stage, further having each second input connecting means for feeding a pressurized fluid to a main stage, operated and displaced by said driving stage and having each output connecting means to which alternatively said pressurized fluid is fed or an exhaust line is connected according to displacement of said main stage;

said first valve being a pressure-servo-valve having first valve control means for feeding back a signal corresponding to a pressure prevailing at said first valve output connecting means for operating said first valve main stage;

said second valve being another pressure-servo-valve having second valve control means for feeding back a signal corresponding to a pressure prevailing at said second valve output connecting means for operating said second valve main stage;

said first valve control means and said second valve control means being designed such that output pressure v. operating current characteristics of said first and second valve intersect within the output pressure/operating current operational range of said first and second valves;

said first and second valves having each their output connecting means connected via a first duct and a second duct, respectively, to opposite ends of said cylindrical bore for feeding, in one operational position, said pressurized fluid into a first portion of said cylindrical bore on said one lateral side of said piston by means of said first valve and for exhausting said pressurized fluid, respectively, from a second portion of said cylindrical bore on said other lateral side of said piston by means of said second valve to thereby displace said carriage in one direction;

a linear displacement measuring device, cooperating with said flexible elongated member to measure a first signal representing the axial position of said piston along said one axis, said measuring device cooperating with an electronic control circuit, said unit receiving a predetermined second signal representing a reference position valve and supplying said electrical control signals to said first valve input connecting means and said second valve input connecting means, respectively, in dependence on a difference between said first and second signals.

15. The modular handling system of claim 14 in which said second module is a short-stroke linear drive having linear displacement means.

16. The modular handling system according to claim 14 in which said second module is a gripping tool having gripping tool jaws actuating means.

17. The modular handling system of claim 14 in which each of said first control means comprises a pressure sensor arranged adjacent said cylindrical bore and being connected to provide an actual pressure valve signal to a first valve control stage and a second valve control stage, respectively, said control stages receiving a desired pressure valve signal and being connected with their outputs to said first valve driving stage and said second valve driving stage, respectively.

18. The modular handling system of claim 17 in which either of said first valve control stage and said second valve control stage comprises:

a subtraction stage for subtracting said desired pressure valve signal from said actual pressure valve signal to generate a differential signal;

a first weighing stage for multiplying said differential signal by a first constant;

a first differentiating stage for generating the first derivative of said actual pressure valve signal;

a second weighing stage for multiplying said first derivative by a second constant;

a second differentiating stage connected to an output of said first differentiating stage for generating the second derivative of said actual pressure valve stage;

a third weighing stage for multiplying said second derivative by a third constant;

a summing stage for summing up output signals or said first, second, and third weighing stage; wherein said summing stages of said first valve control stage and said second valve control stage are connected to said first valve driving stage and said second valve driving stage, respectively.

* * * * *